United States Patent [19]

Besler

[11] Patent Number: 5,067,540

[45] Date of Patent: Nov. 26, 1991

[54] COMBINATION WINDOW FRAME WITH ROLL-UP SHUTTER CHANNELS MOUNTED ON IT AND ASSOCIATED SHUTTER HOUSING

[76] Inventor: Armin Besler, Kuhlehof 16, D-4630 Bochum, Fed. Rep. of Germany

[21] Appl. No.: 105,596

[22] Filed: Oct. 5, 1987

[51] Int. Cl.[5] ..... A47H 1/00

[52] U.S. Cl. ..... 160/31; 160/23.1

[58] Field of Search ..... 160/31, 23.1, 29, 38, 160/26, 133; 49/504, 70

[56] References Cited

U.S. PATENT DOCUMENTS 1,745,208 1/1930 Dixson ..... 160/31

1,925,578 9/1933 Traut ..... 160/31

2,383,015 8/1945 Pratt ..... 160/31 X

*Primary Examiner*—Blair M. Johnson

*Attorney, Agent, or Firm*—Max Fogiel

[57] ABSTRACT

Assembling a window frame with shutter channels mounted on it is facilitated by an indirect or direct mechanical connection of the shutter-housing base plate to the upper leg of the window frame by connectors on the front that extend over the area between the shutter channels, at a distance therefrom over the length of the upper leg of the frame. The screwless connection between the complete shutter housing and the window frame saves time and personnel.

11 Claims, 10 Drawing Sheets

Figure 1:
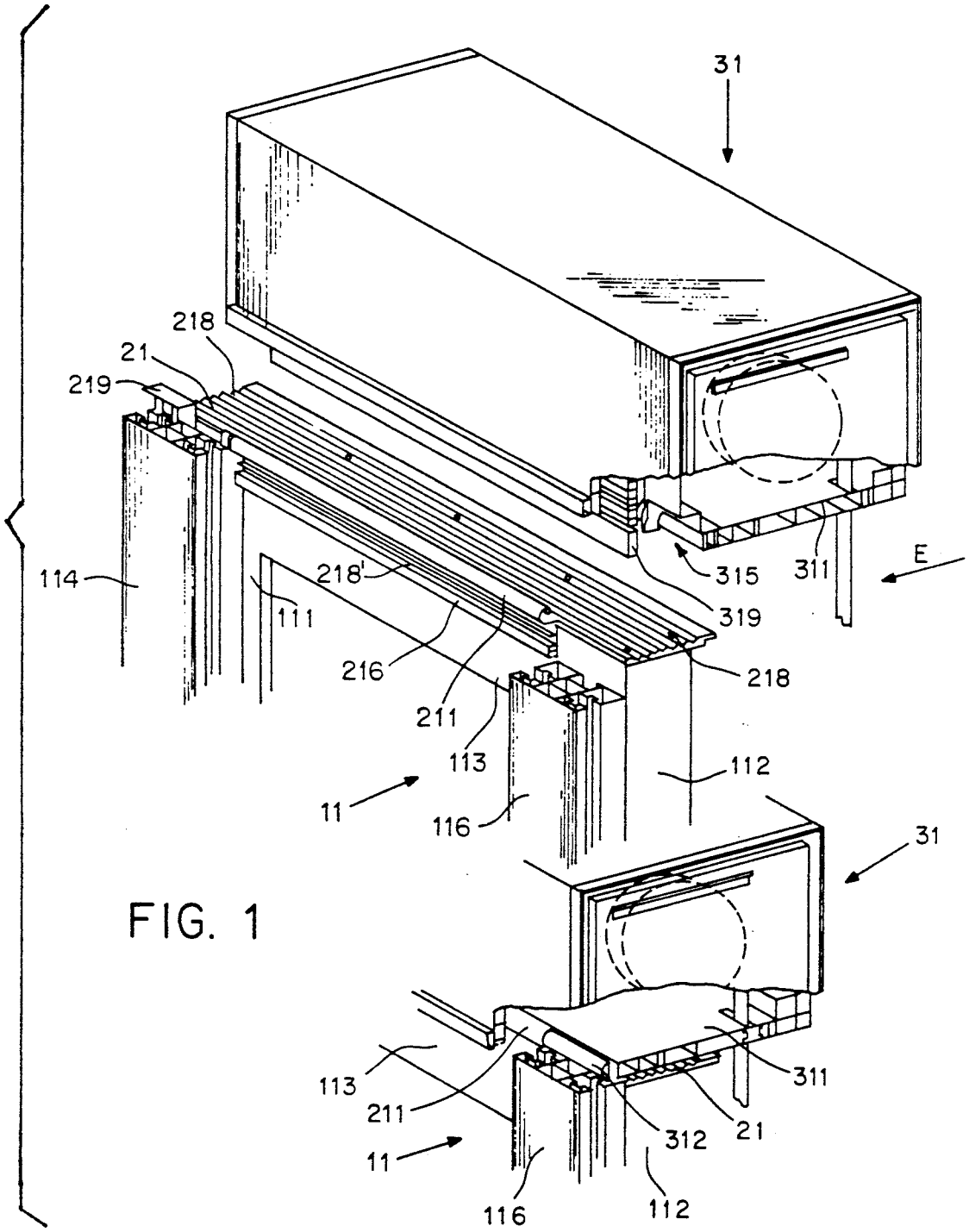

COMBINATION WINDOW FRAME WITH ROLL-UP SHUTTER CHANNELS MOUNTED ON IT AND ASSOCIATED SHUTTER HOUSING

The invention concerns a combination window frame with roll-up shutter channels mounted on it and associated shutter housing.

Window frames with shutter channels mounted on them are generally provided ahead of time, while they are being manufactured, that is, with their associated shutter housings, with the connection between the window frame and the shutter housing being established by screws. The window-frame plus shutter-housing unit is then, subsequent to delivery, inserted into an opening provided for it in the wall and secured therein. In relation to delivery, in particular, the combination window frame turns out to be a drawback, even during manufacture, in that the shutter housing extends into the depth of the window frame and in that the area of the side of the shutter housing that encloses the tape rollers extends over the window frame, causing problems during shipping. When the window frame and the shutter housing are delivered separately, however, securing them together is at least time consuming because it involves disassembling the shutter housing, screwing a baseplate that is a component of the shutter housing to the window frame, and finally reassembling the shutter housing.

With the aforesaid state of the art as a point of departure, the present invention addresses the need for a combination of window frame and shutter housing that can be simply and rapidly established on site.

This object is attained in accordance with the invention in that the combination of a window frame that has shutter channels mounted on it with an associated shutter housing is established by means of an indirect or direct mechanical connection between the baseplate that is a component of the the shutter housing and the upper leg of the window frame, at the front as well, through the area between the shutter-channeling strips and, at a distance therefrom, through connectors that extend over the length of the upper leg of the window frame.

The principle of a mechanical connection between the shutter housing and the window frame can be embodied in various ways, as recited in the subsidiary claims, without departing from the basic concept. The combination of a window frame and a shutter housing can in particular be either indirect, through the intermediary of an adapter associated with the upper leg of the window frame, or direct, assuming that the window frame is made out of strips of structural section that are open along its perimeter.

A connector that is located at the front, is a component of the adapter, and that can be accessed from inside will, in combination with a matching connector that is shaped onto the front of the shutter-housing baseplate and snaps into the adapter connector, allow, first, the window frame to be secured in an opening in the wall, and, second, the shutter housing to be slid from inside over the window frame until the connector on the front of the baseplate snaps into the connector on the front of the adapter.

In embodiments wherein the shutter housing is lowered over the window frame or adapter or wherein the shutter housing is suspended in the front of the adapter and pivoted against the window frame, the shutter housing must be associated with the window frame on site before being moved into the opening in the wall, assuming that there is enough space above the installed window frame for associating the shutter housing with the window frame. It will in any case no longer be necessary to disassemble the shutter housing to permanently connect the shutter-housing baseplate with the upper leg of the window frame.

The combination of a shutter housing and window frame in accordance with the invention results on the whole in the advantages of compact and safe shipping of both the window frame and shutter housing and of ease of assembly on site.

Details of the combination in accordance with the invention will be particularly evident from the description with reference to the drawing.

Figure 1A:
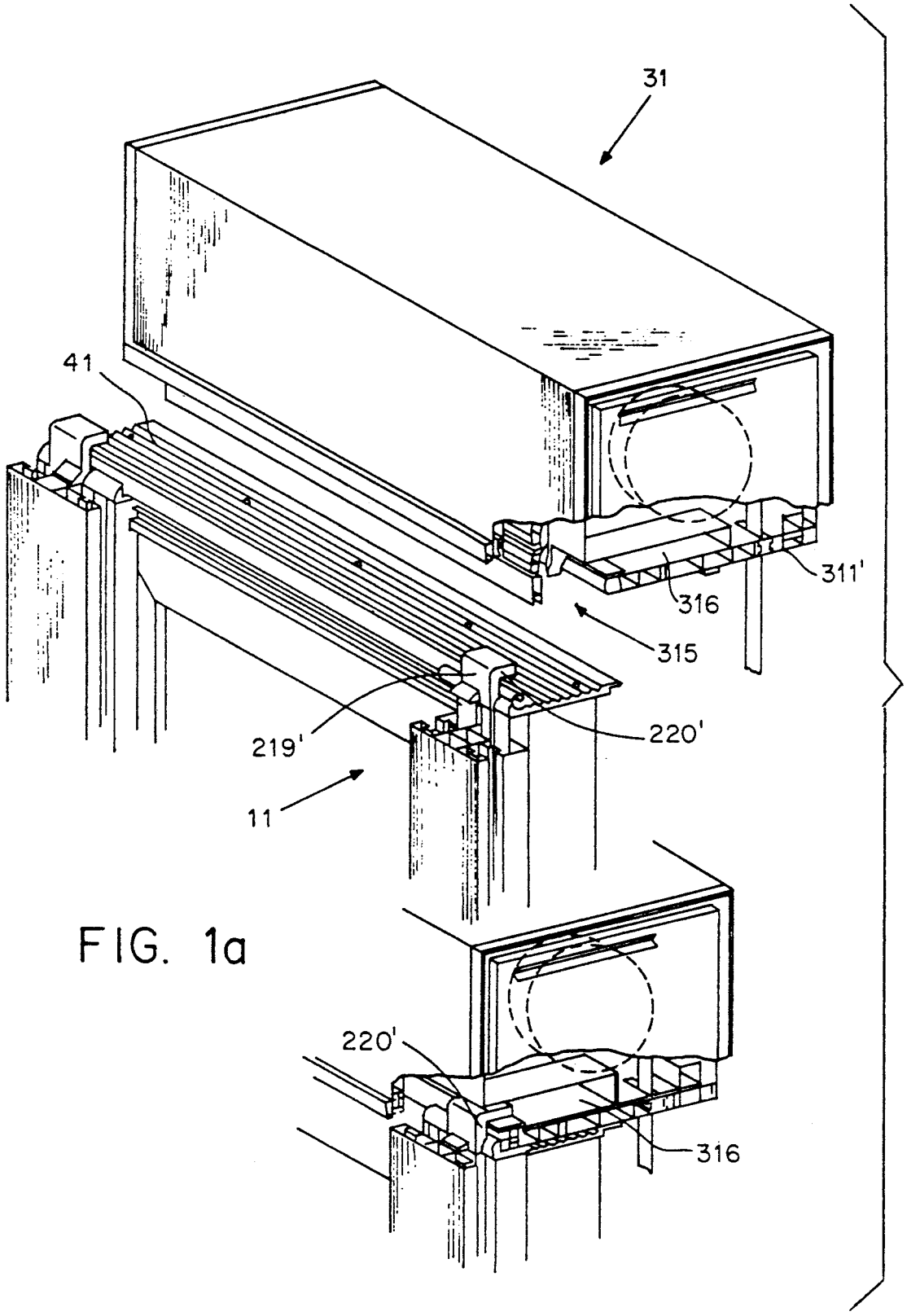
Figure 2A:
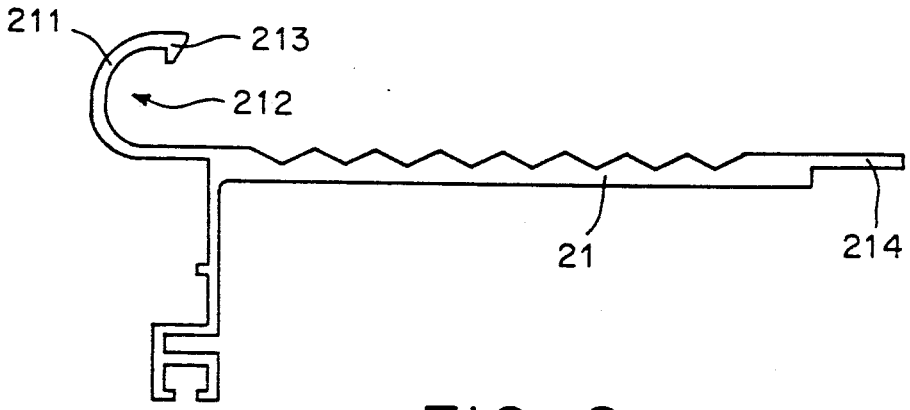
Figure 2B:
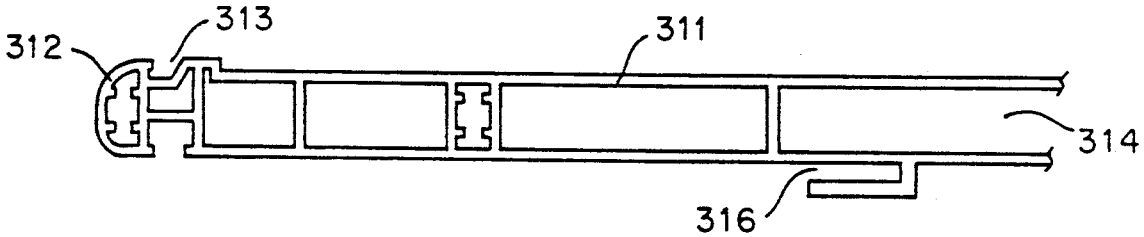
Figure 2C:
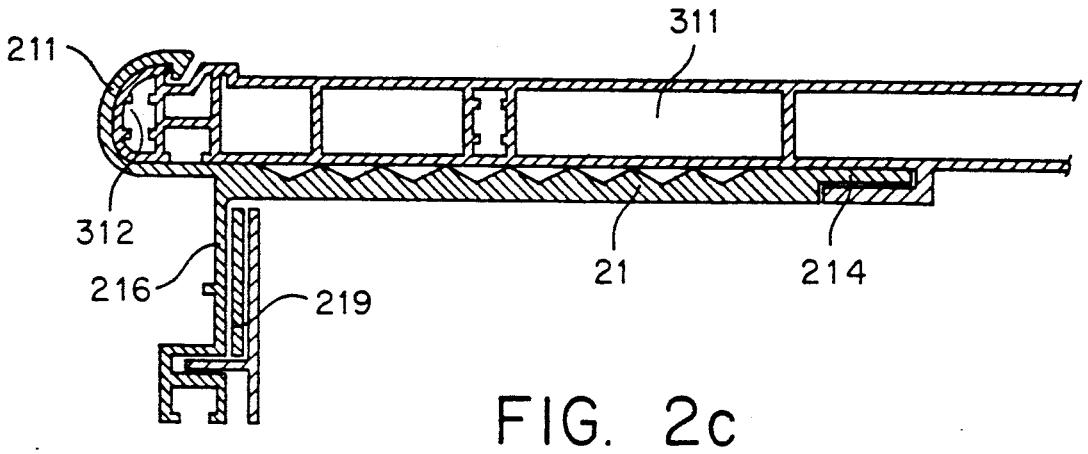
Figure 3:
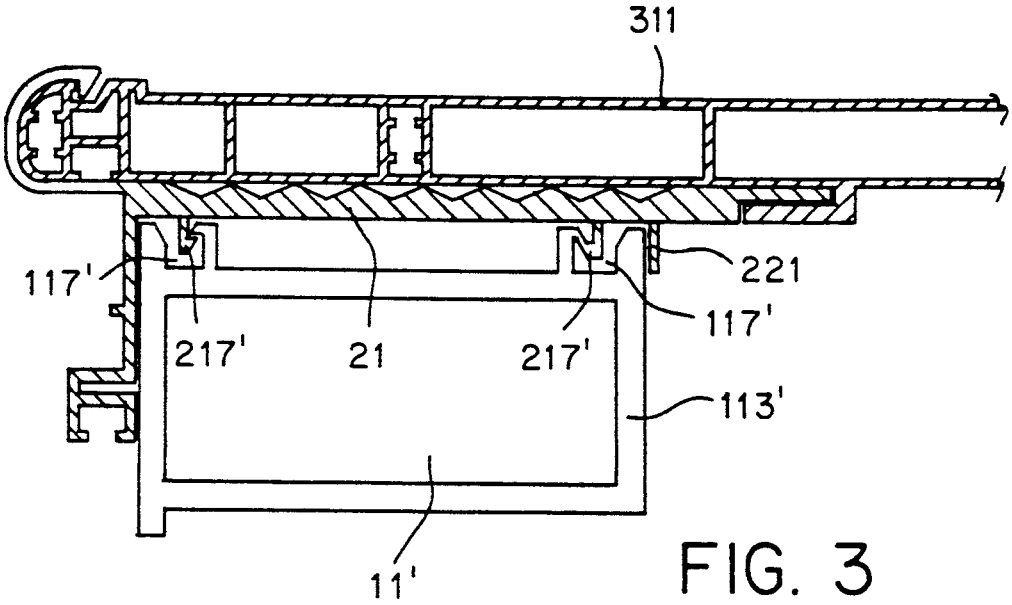
Figure 4:
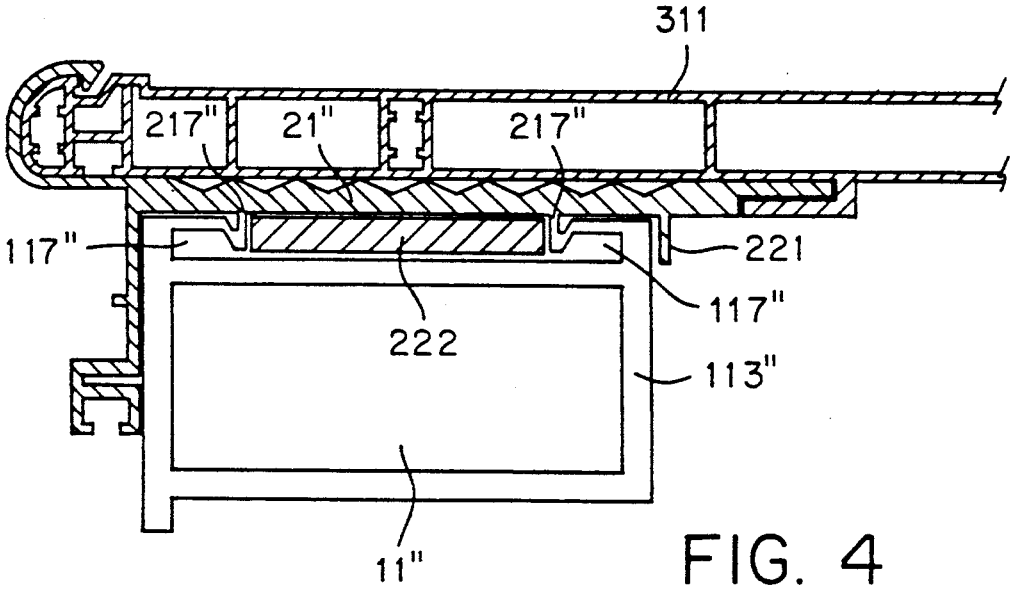
Figure 5:
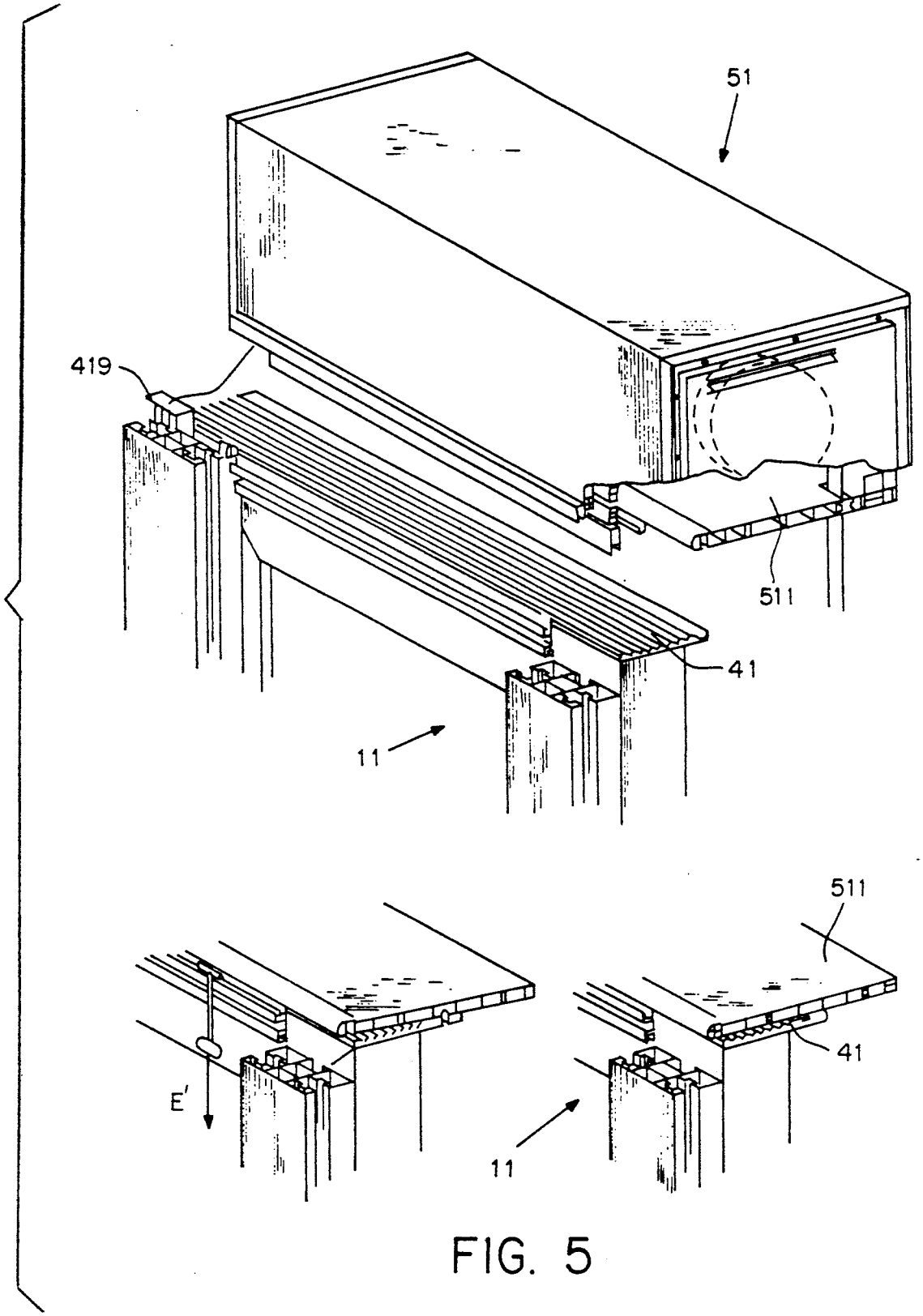
Figure 6:
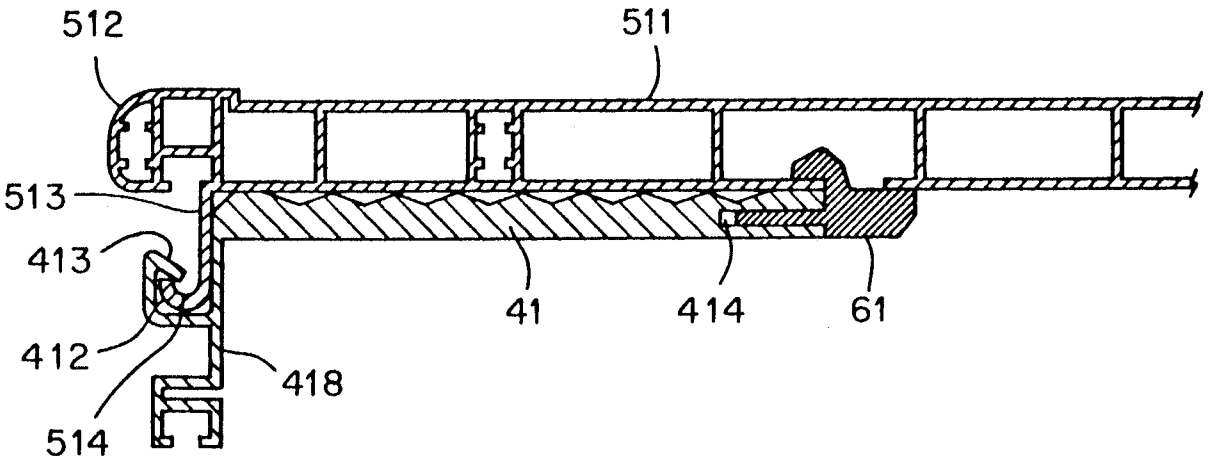
Figure 7:
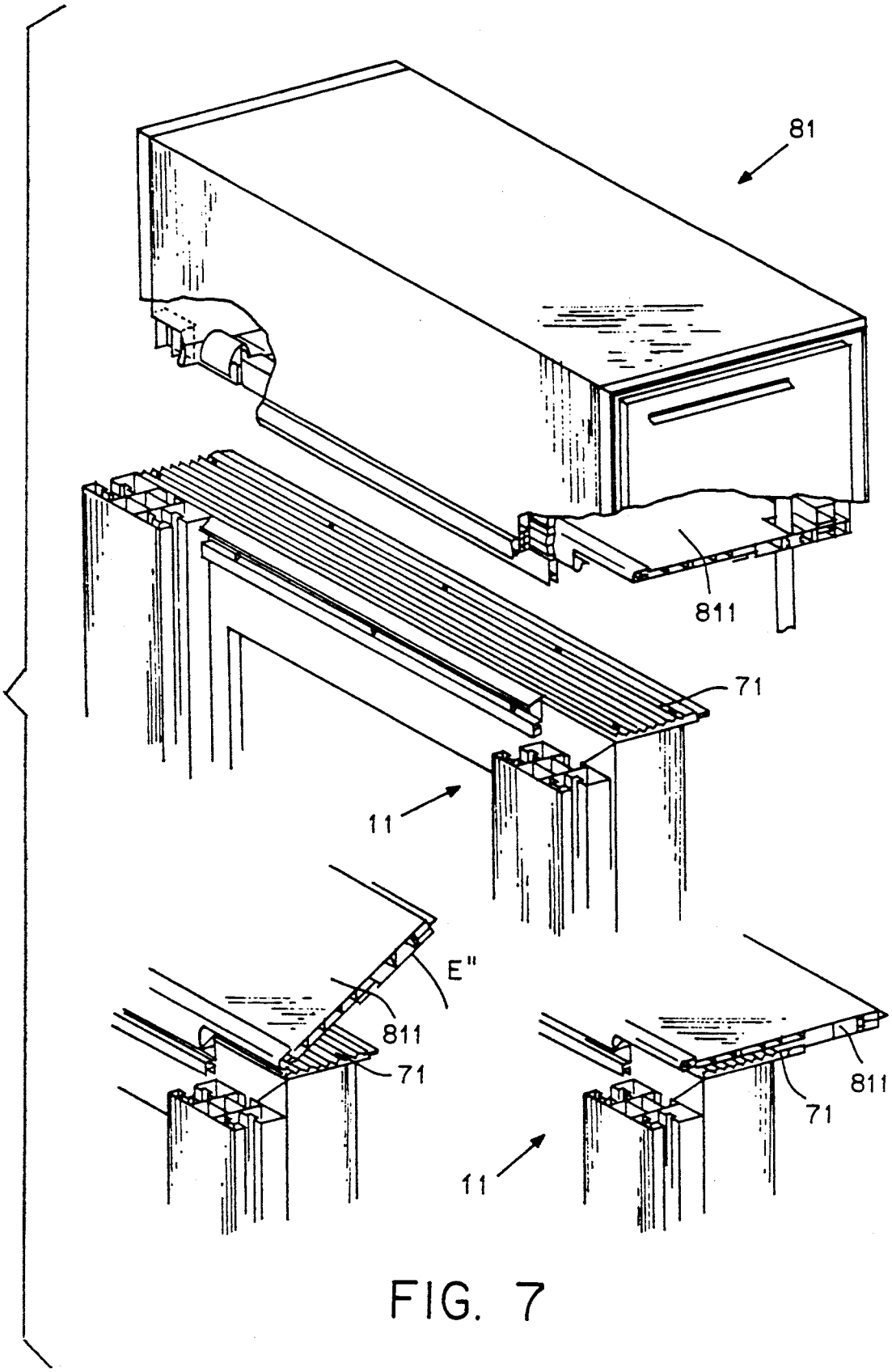
Figure 8A:
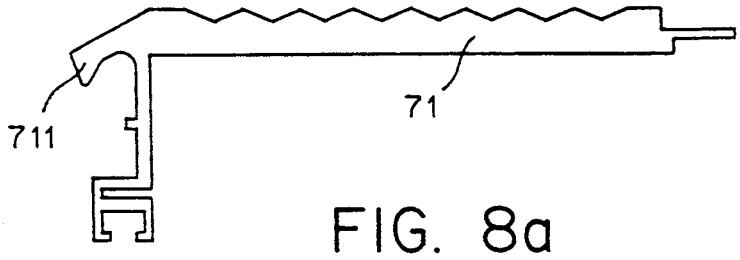
Figure 8B:
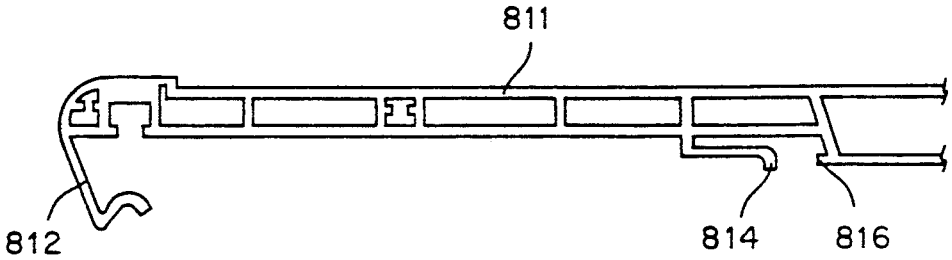
Figure 8C:
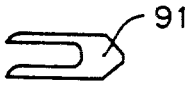
Figure 8D:
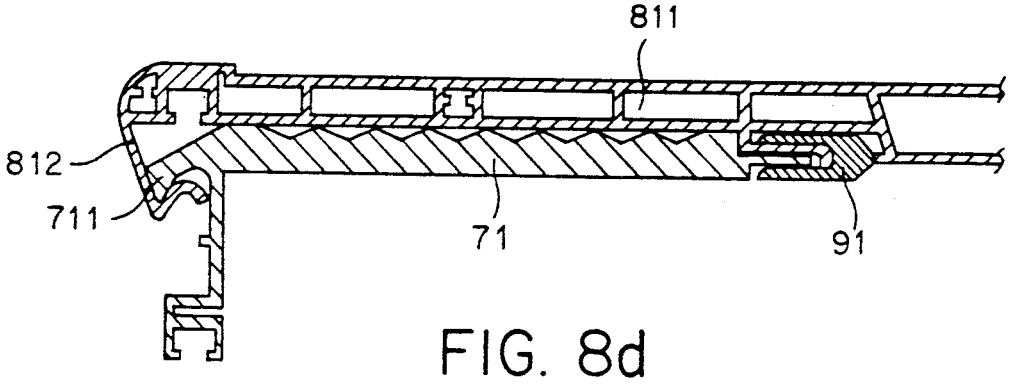
Figure 9:
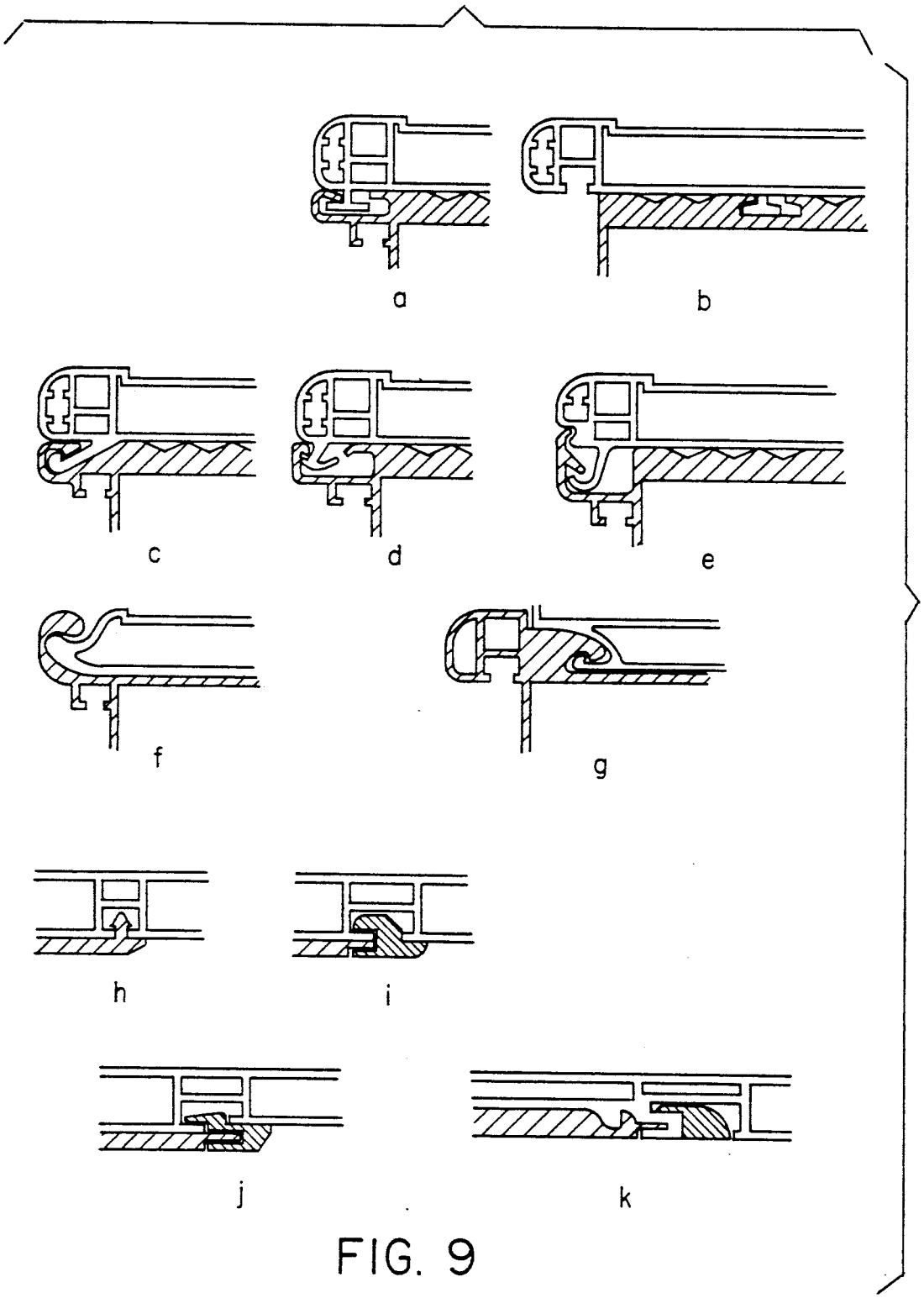
Figure 10:
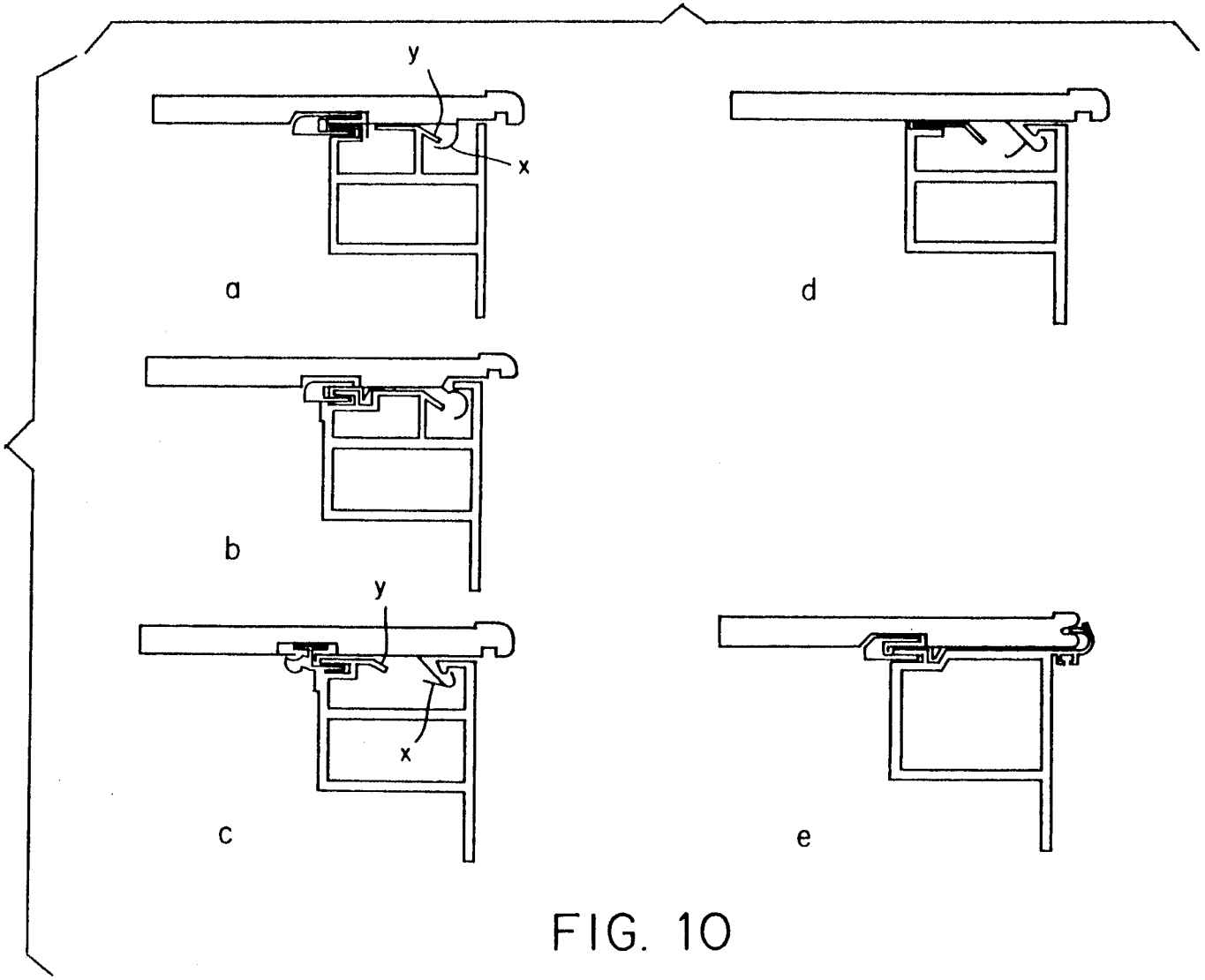

Embodiments of the invention will now be described with reference to the drawing, wherein FIG. 1 comprises an exploded and a partly broken assembled schematic view of one embodiment of a structural set in accordance with the invention, FIG. 1*a* comprises similar views of a variant of the embodiment illustrated in FIG. 1, FIG. 2*a* is a side view of an adapter that constitutes a component of the set illustrated in FIG. 1, FIG. 2*b* is a side view of a matching shutter-housing baseplate that constitutes a component of the set illustrated in FIG. 1, FIG. 2*c* is as section th rough the adapter and the baseplate associated with it, FIG. 3 illustrates an embodiment of the set illustrated in FIGS. 1 and 2 that is a variant in relation to the adapter and to the strip of structural section that the frame is made out of, FIG. 4 is a modification of the embodiment illustrated in FIG. 3, FIG. 5 comprises partly broken and schematic views of another embodiment of the set in accordance with the invention—the first an exploded view, the second showing the set partly assembled, and the third showing it completely assembled, FIG. 6 is a section through the adapter that constitutes a component of the set illustrated in FIG. 5 and through the associated matching baseplate, FIG. 7 comprises partly broken and schematic views of another embodiment of the set in accordance with the invention—the first an exploded view, the second showing the set partly assembled, and the third showing it completely assembled, FIG. 8*a* is a side view of the adapter that constitutes a component of the set illustrated in FIG. 7, FIG. 8*b* is a side view of a matching shutter-housing baseplate, FIG. 8*c* is an end view of a clamping strip that constitutes a component of this set, FIG. 8*d* is a section through the adapter and the baseplate associated with the adapter, FIG. 9 summarizes further types of mechanical connection between the adapter and the baseplate that constitutes a component of the shutter housing, all viewed from the side, and FIG. 10 summarizes types of mechanical connection between appropriately shaped strips of structural section that compose a frame and matching baseplates constituting a component of the shutter housing.

The structural set illustrated in FIGS. 1 and 2 employs a window frame 11 of a known type with shutter-channeling strips 114 and 116 on its lateral legs 111 and 112, an adapter 21 that can be screwed (at 218) onto the upper leg 113 of the window frame, and a shutter housing 31 with a baseplate 311 that matches the adapter such that shutter housing 31 can be mechanically associated with adapter 21. The front of adapter 21 is accordingly provided with an elevation 211 in the form of a pocket 212 that curves out in the vicinity of shutter-channeling strips 114 and 116, projects up beyond the surface that faces away from window frame 11, is accessible from inside, and has a demarcating bead 213 that projects inward and that the matching front 312 of the baseplate 311 that constitutes a component of shutter housing 31 can be inserted into until demarcating bead 213 snaps into a groove 313 shaped into the front 312 of baseplate 311, whereby a pocket 316 that is shaped into the rear 314 of baseplate 311 at the side facing frame 11 and hence adapter 21 and that is open toward the front, slides over a setback 214 at the rear of adapter 21 that projects over frame 11. Shutter-housing baseplate 311 and hence shutter housing 31 are in this way rigidly secured to adapter 21 and hence to frame 11, to the upper leg 113 of which adapter 21 is screwed (at 218). This structural set in a practical way allows window frame 11 to be secured along with its associated adapter 21 in the opening in the wall and shutter housing 31 to subsequently be permanently associated through adapter 21 with the window frame 11 already secured in the opening by sliding it over the window frame 11 provided with an adapter 21 in the direction indicated by arrow E in FIG. 1.

The front of the illustrated adapter 21 is also provided with a bent-out stabilization web 216 that projects back in relation to a connecting component 211 and rests against the front of the upper leg 113 of window frame 11. The rear of stabilization web 216 is lined (at 219) to overcome deviations in the cross-section of different types of shutter channels.

Adapter 21 can also be secured (at 218') to the leg 213 of window frame 11 above stabilization web 216. The elevation 211 of adapter 21 also constitutes an edge for shutters 319 to roll over.

The embodiments of the set just described with reference to FIGS. 1 and 2 illustrated in FIGS. 3 and 4 allow, when frame section 11' or 11" is appropriately designed, an adapter 21' or 21" to be secured without screws to the upper leg 113' or 113" of the particular window frame. Hook-in components 217' and 217" that extend over the length of adapter 21' or 21" and project beyond it are for this purpose provided in both cases on the side of the adapter that faces window frame 11' and 11" and mechanically engage recesses 117' and 117" in frame section 11' or 11". In this context an additional stabilization web 221 that rests on the inside of the window frame will be practical. In the embodiment illustrated in FIG. 4 a wedge 222 helps to maintain the mechanical connection between the window frame and the adapter.

The recess for the connector on the baseplate 511 of the shutter housing 51 in the embodiment illustrated in FIGS. 5 and 6 extends from stabilization web 418 at a distance from the surface of adapter 51 that faces the housing. The pocket 412 in this embodiment is accessible from above and has a demarcating bead 413 that extends inward. A connecting web 513 accordingly extends from baseplate 511 at a distance from the face 512 that constitutes the edge for the shutter to roll over, rests against the stabilization web 418 of adapter 41, and ends in a claw 514 that extends in the opposite direction from the pocket or claw 412 on adapter 41.

When shutter housing 51 is mounted (in the direction indicated by arrow E' in FIG. 5) on the window frame and hence on adapter 41, the connector 514 on the baseplate 511 that constitutes a component of shutter housing 51 snaps into the corresponding connector—pocket or claw 412, that is—on adapter 41. In this case, shutter housing 51 is secured to the inside of the window frame by means of a clamping strip 61 that encloses and grips the facing inner surfaces of adapter 41 and of the baseplate 511 that constitutes a component of shutter housing 51. An additional clamping action results in the illustrated case in that the section of the wall of adapter 41 where baseplate 511 is secured to the adapter consists of slots in the adapter and in that clamping strip 61 fits tightly into the resulting slot 414 in the adapter.

The adapter in the structural set illustrated in FIGS. 7 and 8 has an undercut connecting web 711 that projects out of the front and is enclosed in a claw 812 shaped onto the front of the baseplate 811 that constitutes a component of shutter housing 81. The shutter housing in this case is mounted on the window frame, specifically on adapter 71, as illustrated at the bottom left of FIG. 7, and pivoted in the direction indicated by arrow E" against the adapter or the window frame. The baseplate 811 that constitutes a component of shutter housing 81 is also connected on the inside to adapter 71 by a clamping strip 91 that bridges and clamps together the facing sections of the walls of adapter 71 and of baseplate 811. The illustrated embodiment also has a stop 814 that prevents shutter housing 81 from sliding forward while connection 711 and 812 is lifted and clamping strip 91 is being mounted, and another stop 816 that prevents clamping strip 91 from coming loose automatically.

A prerequisite to final assembly of the embodiment illustrated in FIGS. 5 and 6 and to the one illustrated in FIGS. 8 and 9, once the window frame has already been installed, is enough free space in the wall above the window frame. Otherwise the shutter housing will have to be associated with the window frame on site before the frame is inserted into the opening in the wall. In this case as well the strictly mechanical connection between the shutter housing and the window frame by means of the adapter associated with the window frame turns out to be practical because the window frame and shutter housing can be delivered separately and it will no longer be necessary to disassemble the shutter housing before it is associated with the window frame.

Practical aids to assembly are provided in the form of channeling components, 220 (FIG. 1) and 419 (FIG. 5) for example, that are inserted into shutter-channeling strips 114 and 116 from above and ensure correct positioning of shutter housing 31 or 51 in relation to window frame 11 so that the shutter, 319 for example, can enter shutter-channeling strips 114 and 116. The channeling components can, as illustrated in FIG. 1, be introduced into shutter-channeling strips 114 and 116 ahead of time. Channeling components 219' will then fit into recesses provided for that purpose in the baseplate 311 of shutter housing 31 while the shutter housing is being mounted on window frame 11 in the direction indicated by arrow E. If, as illustrated in FIG. 1*a*, an angled edge section 220' is provided on channeling component 219' and fits tightly, once the overall set has been assembled, into a pocket 316 shaped onto the baseplate 311' of shutter housing 31, it will contribute to permanently securing shutter housing 31 in relation to adapter 41 and hence also to window frame 11. The channeling components 419 in, say, the embodiment illustrated in FIG. 5 are mounted on the baseplate 511 of shutter housing 51. In this case they will fit (in the direction indicated by arrow E' in FIG. 5) into the shutter-channeling strips correctly positioned in relation to shutter housing 51 and window frame 11 while shutter housing 51 is being mounted.

FIG. 9 is a summary of various approaches to mechanically securing the adapter mounted on the upper leg of the window frame to the baseplate that constitutes a component of the shutter housing associated with the window frame that differs from the techniques illustrated in FIGS. 1 through 8. Details a through g, specifically, represent attachment at the front and h through k attachment inside.

The combination window frame and associated shutter housing by means of an adapter in accordance with the invention represents a comparatively cost-effective solution of the problem because existing strips of structural section do not in principle need to be modified in any way at all, and it is only the shutter-housing that needs to be changed. The problem, however, can also basically be solved without an adapter if the strips of structural section and shutter-housing baseplate are appropriately designed, as will be evident from FIG. 10. The components—of the upper leg of the frame and of the baseplate, that is—are also mechanically connected in this case as well, accompanied by a clamping strip in the vicinity of the front and on the inside, making it unnecessary to screw them together and in particular allowing the shutter housing to be associated with the window frame without disassembly.

The hook-shaped structures x that constitute a component of the shutter-housing baseplate illustrated in FIGS. 10*a* through d represent an installation aid in conjunction with the flat structures y of the strip of structural section.

I claim:

1. A combination window frame with a top frame member and spaced parallel frame members, a pair of roll-up shutter channels which are mounted on respective said side frame members and an associated shutter housing, further comprising front connectors on said top frame member of said window frame and extending between the shutter channels; said front connectors being spaced from said shutter channels; said shutter housing having a shutter-housing base plate; first coupling means on said base plate; said top frame member having a flat adapter extending over the length thereof and projecting forward and backward beyond said member, said adapter being bent out in a vicinity of the shutter channels and having longitudinal edges in the form of matching connectors that match said front connectors so that at least said front connectors and said matching connectors engage with each other; second coupling means on said adapter for engaging said first coupling means on said base plate, whereby said adapter mounts said shutter housing to said window frame.

2. A combination as defined in claim 1 wherein said to matching of connector is pocket shaped for accommodating a corresponding front connector.

3. A combination as defined in claim 2 wherein said a front connector fits and is anchored into said pocket in assembled state.

4. A combination as defined in claim 2 wherein said pocket extends over a surface of said on a side facing away from said upper leg.

5. A combination as defined in claim 2 wherein said pocket is accessible from above.

6. A combination as defined in claim 1 wherein said adapter can be attached to said window frame by screws.

7. A combination as defined in claim 1 including channeling elements insertable into said shutter channels from above and extending beyond the upper leg of said frame, said channeling elements fitting into recesses in an edge of said base plate.

8. A combination as defined in claim 7, wherein one of said channeling elements has a bent-in edge section at a free end fitting tightly into a pocket shaped into said base plate.

9. A combination as defined in claim 1 including channeling elements extending out of said base plate and insertable from above into said shutter channels.

10. A combination window frame with roll-up shutter guides mounted thereon and an associated shutter housing on top of said frame comprising: said window frame having an upper frame member and spaced side frame members; said roll-up shutter guides mounted on said side frame members; said shutter housing mounted on top of said upper frame member; said housing having a base plate; first coupling elements on said upper frame member over a region between said shutter guides and spaced from said shutter guides, said first coupling elements extending substantially over the length of said frame member; and adapter removably attaching said housing to said upper frame member, said adaptor being attached to said upper frame member and extending over the the length of said base plate and having second coupling elements corresponding to and engaging said first coupling elements; and means on said adapter for connecting said adapter to said base plate, whereby said adapter mounts said shutter housing to said window frame.

11. A combination window frame with a front side and with roll-up shutter channels mounted thereon and an associated shutter housing, comprising: said window frame having an upper frame member and spaced side frame members; said roll-up shutter channels mounted on said side frame members; front connectors on said front side of said window frame and extending over an area between the shutter channels substantially over the length of said upper frame member; said front connectors being spaced from said shutter channels; said shutter housing having a base plate; coupling means removably attaching said housing to said upper frame member, said adaptor being attached to said base plate; an adapter on said upper frame member and having an inner edge; said coupling means on said base plate comprising a longitudinal slot; and a projecting element on said inner edge and extending alternately into said slot, whereby said adapter mounts said shutter housing to said window frame.

* * * * *